US006216894B1

(12) United States Patent
Hendricks

(10) Patent No.: US 6,216,894 B1
(45) Date of Patent: Apr. 17, 2001

(54) STACKABLE NEWSPAPER RACK HAVING U-SHAPED SECTIONS

(76) Inventor: Robert Hendricks, 47 Redfern Dr., Youngstown, OH (US) 44505

( * ) Notice: Subject to any disclaimer, the term of this patent is extended or adjusted under 35 U.S.C. 154(b) by 0 days.

(21) Appl. No.: 09/218,888

(22) Filed: Dec. 22, 1998

(51) Int. Cl.[7] ..... A47B 47/04; A47F 7/00
(52) U.S. Cl. ..... 211/194; 211/45; 312/111
(58) Field of Search ..... 211/42, 45, 194; 411/389; 312/111, 108, 107; 108/91, 93

(56) References Cited

U.S. PATENT DOCUMENTS

| | | | | |
|---|---|---|---|---|
| D. 242,751 | | 12/1976 | Wells . | |
| D. 316,118 | | 4/1991 | Cole . | |
| 764,839 | * | 7/1904 | Casler | 312/107 |
| 1,116,304 | * | 11/1914 | Lundstrom | 312/108 |
| 3,834,324 | | 9/1974 | Lang . | |
| 3,918,781 | * | 11/1975 | Paris | 312/111 |
| 4,384,751 | * | 5/1983 | Guntermann et al. | 312/265.4 |
| 4,632,412 | * | 12/1986 | Nasgowitz | 280/47.26 |
| 4,787,687 | * | 11/1988 | Merl | 312/100 |
| 4,852,749 | * | 8/1989 | Fernandez et al. | 211/126.2 |
| 4,947,996 | | 8/1990 | Harris . | |
| 5,150,813 | | 9/1992 | Harris et al. . | |
| 5,211,292 | * | 5/1993 | Paolucci | 211/40 |
| 5,318,182 | * | 6/1994 | Thorud et al. | 206/509 |
| 5,394,997 | | 3/1995 | Gollob . | |
| 5,575,396 | | 11/1996 | Smed . | |
| 5,630,658 | * | 5/1997 | Jeter | 312/107 |
| 5,769,583 | * | 6/1998 | Girbinger | 411/389 |
| 5,845,577 | * | 12/1998 | Nelson et al. | 101/494 |
| 5,862,922 | * | 1/1999 | Gallagher | 211/41.12 |

* cited by examiner

*Primary Examiner*—Daniel P. Stodola
*Assistant Examiner*—Gregory J. Strimbu
(74) *Attorney, Agent, or Firm*—Robert Lev

(57) ABSTRACT

A sectional system for constructing newspaper and other periodical stands in a variety of different configurations. The system includes a plurality of generally U-shaped sections that are stackable upon each other. The sections are preferably formed of spin-molded plastic and include a base section, a shelf section and a display section. The shelf section comprises a horizontal display section while the display section comprises an angled display section.

11 Claims, 2 Drawing Sheets

53
51
5
10
10
11
4
11
31
3
33
10
10
11
4
10
10
23
21
2
1

STACKABLE NEWSPAPER RACK HAVING U-SHAPED SECTIONS

TECHNICAL FIELD

The invention relates generally to vending, storage and display racks for newspapers, periodicals and the like, used at the point of sale. In particular, the present invention is directed to a flexible newspaper display and storage system admitting to a variety of configurations.

BACKGROUND ART

When marketing newspapers, magazines and the like, at retail levels, the newspapers or other periodicals are stacked on a rack or stand for both storage and display to customers. Conventionally customers pick the newspaper or other periodical off the rack and present the newspaper to a cashier for purchase. Because so many newspapers and other periodicals are sold in this manner, the capability of storing large amounts of stock as well as properly displaying it is very important.

Traditionally, racks and stands for presenting newspapers and other periodicals for sale have included an open box, which is normally fabricated of metal wires or bars, or of solid sheet material. For a number of reasons designs having solid metal sides have lost popularity except when used as vending machines. When using the most popular open wire design, the wires are welded together to form five sides of the box, which is usually open at either the front or the top.

Unfortunately, such arrangements have certain drawbacks. For example, a rack made out of a wire frame often appears to be of cheap or flimsy construction. This perception can have an adverse effect on potential customers, who may look upon the product as not being worth the effort of a better presentation.

In many cases the wire frame rack is flimsy, requiring that the rack be located close to the ground in order to maintain the assemblence of stability. Because of this location, customers are often forced to stoop for the newspaper creating inconvenience and possible aggravation. Thus, leading to adverse feelings towards the product dispensed in such a fashion. Very often the wire frame racks are so flimsy that they do not long survive normal abuse, such as accidental collisions with pedestrians, hand trucks, bicycles or the like. Such accidental collisions are always likely in any public place. Since the wire frame structures are relatively flimsy, there are severe limitations on the amount of product that can be stored therein.

Because of the construction of the wire racks and stands, there is a tendency for such racks to deform, leading to hazards such as sharp edges. This condition can lead to additional difficulty since customers are often very casual when reaching into the rack to obtain newspapers or other periodicals. As a result, customers can be injured by the sharp edges or even accidental contact with jagged or warped sides of the rack which are not easily perceived.

Conventional wire frame racks are also awkward in that they are difficult to assemble and move about. In order to obtain the desired level of rigidity, wire racks often have to be secured to a wall, floor or other stationary support, thereby creating additional inconvenience for the vendor as well as possible customers.

Another type of conventional rack used for dispensing newspapers and other periodicals is a type having solid walls which are made entirely of plastic. Such structures are usually molded to form a shelf on which the products to be dispensed are supported. The plastic structure must be formed of sufficient strength to endure the normal abuse received by any piece of equipment in a public place. Further, the plastic newsstand must also be sufficiently tall to raise the newspapers or periodicals a sufficient distance from the ground or floor to properly display the product for sale. Racks of molded plastic are conventionally adapted to become much thicker and apparently more clumsy in order to support a newspaper display at the "eye-height" of a normal consumer. As a result, plastic racks and newsstands are often as awkward in appearance as the wire frame rack.

The required rigidity to support newspapers at a desired height in combination with an appealing appearance is found in the structure disclosed in U.S. Pat. No. 5,394,997 to Gollob. This structure includes wire shelves that slide into groves molded into the sidewalls of a plastic body. The free standing body is hollow and is formed by rotation molding. The stand is a very rigid structure, easily able to withstand the usual abuse of a public sales-location. The sidewalls extend only half way along the shelves, leaving the separately-formed shelves protruding from the sidewalls. As a result, the rack is strong and substantial while still maintaining an attractive appearance. The newspapers or other periodicals are presented for sale in an accessible manner. The plastic body is so molded to include groves having notches, acting as detents to hold the separately-formed shelves firmly within the groves.

The arrangement of the Gollob newspaper rack is limited to that determined during the original manufacture of the rack. Consequently, this rack lacks adaptability to a variety of different locations and presentations requirements. In contrast, a variety of presentation arrangements is available using the device disclosed in U.S. Pat. No. 4,947,996 to Harris. This device is a holder for displaying articles such as pamphlets, brochures and the like. The holder is formed out of plastic or paperboard sheet and is foldable into a generally triangular section which defines a base panel, back panel and inclined display portion. A front pocket is united with the triangular section to define a front panel, side panel and forward extension of the base panel for insertion of articles into the front pocket section so that the articles rest against the inclined support of the triangular section.

While offering adequate presentation of the periodicals to be sold, the Harris device has many of the limitations of the wire newspaper rack. For example, the Harris display holder must be elevated by some structure. Otherwise, customers must stoop to pick up the articles from the floor on which the display holder is placed. Further, the display holder of Harris is somewhat limited in it's storage capacity, as well as it's display configuration.

A more adaptable newspaper display rack is disclosed in U.S. Design Pat. No. 242,751 to Wells. A central column is used to support a number of newspaper/periodical holders which are attached thereto. The arrangement of Wells requires that the central column be supported by radially extending feet, large enough to provide stability for a column capable of supporting radially extending newspaper racks. Because of this arrangement, there are severe limitations on the amount of newspapers, pamphlets or other periodicals that can be placed on each of the extending racks. Further, there are severe constraints regarding the amount of product that can be stored with this system as well as being displayed. While varying numbers of newspaper racks can be arranged around the central column, there are some other constraints with respect to the type of arrangement which is possible and the space into which it can be arranged.

Accordingly, despite the variety of different newspaper display and storage systems available, there is still an acute need for highly flexible newspaper display and storage systems for use at point-of-sale locations. Such systems must be flexible enough to fit into a variety of different locations and thus, must have a wide range of configurations. Such display systems must also be sufficiently adaptable to be arranged to accommodate a large number of newspaper and periodical types and sizes.

SUMMARY OF THE INVENTION

Accordingly, it is one object of the present invention to provide a highly flexible and adaptable newspaper display rack system that can be arranged within a variety of different spaces, requiring a wide variety of configurations.

It is a further object of the present invention to provide an adaptable storage and display rack for a wide range of newspapers, brochures, pamphlets, magazines.

It is another object of the present invention to provide a newspaper rack display and storage system that can be preassembled in a variety of different configurations.

It is still another object of the present invention to provide a newspaper and periodical display and storage rack which is made of a light material and is easily assembled on sight to conform with available space.

It is again a further object of the present invention to provide a newspaper and periodical display and storage system that requires minimal maintenance and is relatively impervious to retail environment abuse.

It is yet an additional object of the present invention to provide a newspaper and periodical display and storage rack having a pleasing appearance, and which can be provided in a variety of different colors.

It is again another object of the present invention to provide a newspaper display rack having areas available for display graphics.

It is still an additional object of the present invention to provide an extensive newspaper and periodical display and storage system that is easily moved and readapted to a variety of different conditions.

It is again a further object of the present invention to provide a newspaper and periodical display and storage system that provides a plurality of different display modes, and storage configurations.

These and other objects and goals of the present invention are achieved by a system for arranging variable configurations of an upright, self-supporting periodical display/storage structure formed from a plurality of stackable interconnectable sections. The system includes a base section configured to be supported by a supporting surface and arranged to support other sections stacked thereon. The base section has U-shaped vertical sidewalls with devices for connecting to an adjacent section. The connecting devices are formed within the vertical sidewalls. The system also includes at least one shelf section having U-shaped vertical sidewalls conforming to the U-shaped sidewalls of the base section. The shelf section also includes a horizontal shelf structure arranged within and perpendicular to the U-shaped vertical sidewall structure. The vertical sidewalls contain devices for connecting to other sections above and below the shelf section.

DETAILED DESCRIPTION OF THE PREFERRED EMBODIMENTS

Figure 3:
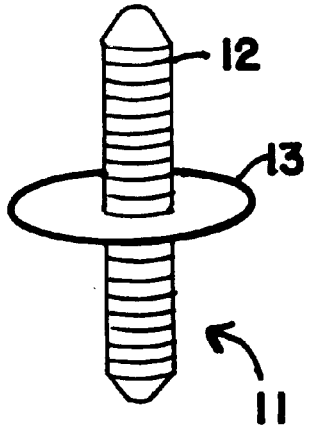
FIG. 3 is a perspective diagram of a connector used with the present invention.

The present invention is essentially a system for arranging a wide variety of different configurations for a newspaper/periodical display and storage stand. When fully assembled, the stand has contiguous sidewalls and backwall. The stand is composed of sections configured to be stacked upon each other in a wide variety of configurations. The assembled structure is stable due to the contiguous arrangement of the vertical side and backwalls from section to section. Stability is further enhanced by connectors 11 (as depicted in FIG. 3) which extend into apertures or recesses 10 in adjacent sections.

Figure 1:
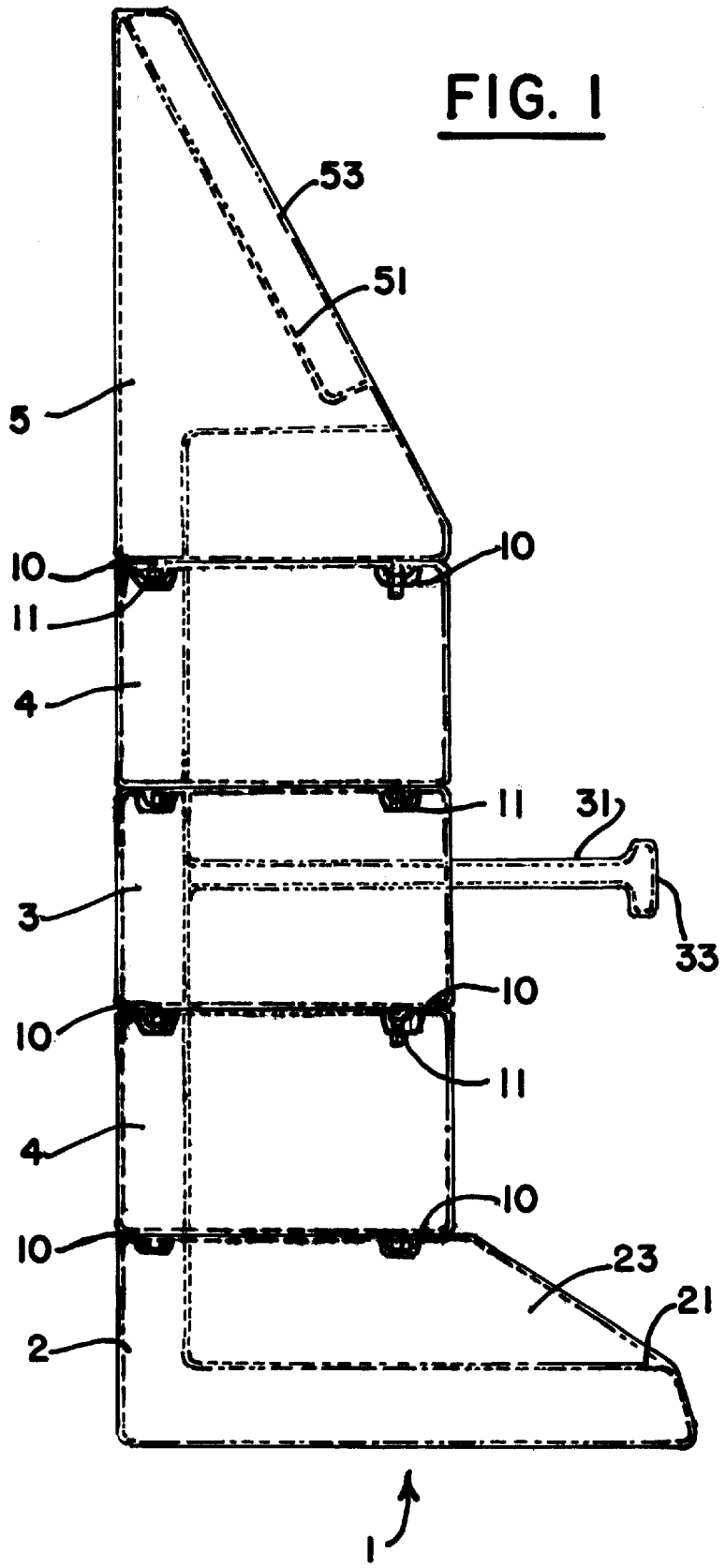
FIG. 1 is a side elevation view diagram depicting one configuration of the present invention.
Figure 2:
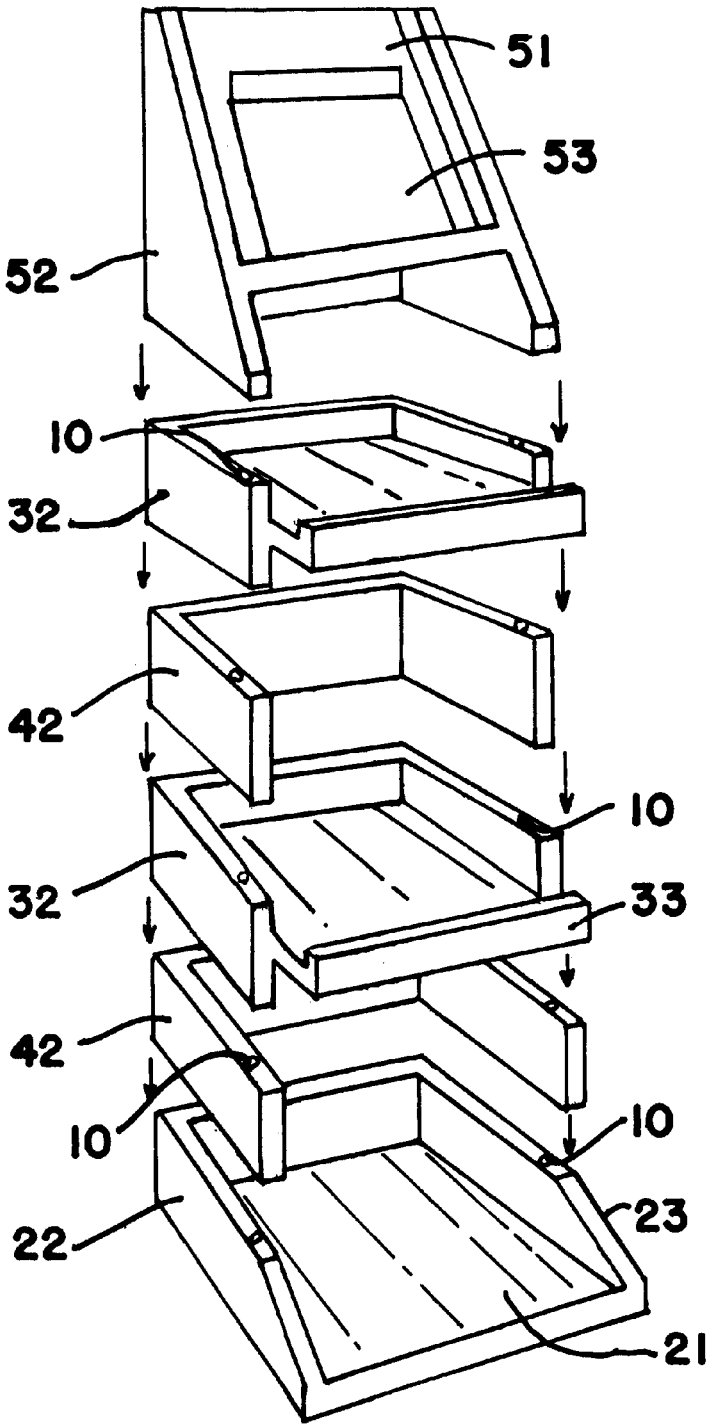
FIG. 2 is a exploded perspective view diagram of another arrangement of the present invention.

Further stability for the entire structure 1 is provided by the configuration of a base section 2 (as depicted in FIG. 1 and FIG. 2). Base unit 2 is configured to support all subsequent sections stacked thereon by virtue of its vertical sidewalls 22. The base section has a horizontal surface 21 upon which newspapers and other periodicals may be placed as part of the display and storage of such items. The weight of the periodicals arranged on surface 21 also helps to provide additional stability to the overall stand structure 1. Further stability is provided by extension 23 which extends beyond the sidewalls of the sections stacked on the base unit. As a result of this relatively large "foot print", there is far less likelihood of tipping or other instability even when substantial numbers of sections are stacked on each other. The provision of this stability is a crucial factor in allowing the variable configurations of the present invention.

Newspapers and other periodicals can also be stored or displayed on shelf unit 3, which has a horizontal surface 31 extending beyond sidewalls 32. The horizontal surface 31 ends in a vertical structure 33 that may be used for text or other graphics, identifying the products contained in the stand 1, or providing advertising.

In order to increase the amount of material that can be contained on each of the horizontal surfaces 31 and 21, spacer sections 4 may be added to the overall structure, further separating the horizontal surfaces 31, 21 from each other. The spacer sections 4 contain only sidewalls and no horizontal surfaces. The spacer sections are connected to adjacent sections in the same manner that the base section and the shelf section are connected.

Each of the spacer sections, base section, and shelf sections have connection apertures 10 which permit holding of protrusions (such as connector 11 in FIG. 3), thereby permitting a stable connection between adjacent sections. While a substantially cylindrical bolt 11 can be configured with threads 12, this is not a requirement for the correct operation of the present invention. Rather, any connector that can hold an upper surface of a vertical sidewall to the lower surface of a vertical sidewall of adjacent sections can be used. Spacer ring 13 may preferably be used to maintain the correct amount of penetration by connector 11 into either the adjacent sections that it may be holding together. However, while convenient, spacer ring 13 is not necessary for the operation of the present invention. Any kind of appropriate connector that would occur to one skilled in this art can be used.

Upright display section 5 is used only at the top of the stand 1, when considered desirable. Rather than the horizontal structure 31 used shelf section 3, display section 5 uses a substantially upright surface 51 for the display of a small number of periodicals or newspapers. This structure may be formed at an angle between 45° and 65° from horizontal for optimal viewing of the products displayed thereon. These products are held to surface 51 by way of a clear plastic holder 53, constituted by a plastic sheet which can be bent or otherwise configured to maintain spring tension against surface 51, thereby holding the displayed product firmly in place.

Each of the sections, 2, 3, 4 and 5 have a U-shaped vertical sidewall structure. The interface between adjacent section takes place by way of the respective top and bottom edges of the sidewall structure through which holding apertures 10 are formed to allow holding fittings 11 to be placed. Forming the connecting recesses 10 in each of the sections is relatively easy since each section is a hollow structure formed by spin or rotation molding resulting in the hollow plastic shell. Because each section is a hollow plastic shell, the stand 1 is relatively easy to assembled or otherwise handle. Also, a wide variety of arrangements, styles and configurations can be facilitated by the capabilities provided by the present invention.

While a number of different sizes and configurations have been shown by way of example as part of the description of the present invention, the present invention should not be construed to be limited thereby. Rather, the present invention should be interpreted to encompass any variations, modifications, permutations, adaptations or other embodiments that may occur to one skilled in the art having been taught the present invention. Consequently, the present invention should be construed as being limited only by the breadth of the following claims.

I claim:

1. A modular storage system for storing periodicals, comprising:

a plurality of interconnectable horizontally U-shaped plastic sections, each of said plastic sections having three vertical walls;

at least one of said plastic sections comprising a base section having a permanently fixed horizontal bottom plate structure adapted to be supported by a supporting surface, said base section supporting an adjacent one of said plastic sections, said walls of said base section having means for connecting to said adjacent one of said plastic sections and being arranged adjacent said horizontal bottom plate structure;

at least one of said plastic sections comprising a shelf section, said walls of said shelf section having a horizontal shelf structure permanently attached thereto which extends in a direction perpendicular to said walls of said shelf section, said walls of said shelf section containing means for connecting to an adjacent one of said plastic sections disposed above said shelf section and an adjacent one of said plastic sections disposed below said shelf section; and, at least one of said plastic sections comprising a display section for displaying at least one of the periodicals and having means for connecting to an adjacent one of said plastic sections arranged below said display section and a display surface comprising a clear plastic extending between said walls of said display section and angled toward at least one of said walls of said display section.

2. The system of claim 1, wherein said base section and said shelf section are stacked to form a structure having substantially contiguous vertical sidewalls.

3. The system of claim 2, wherein said base and shelf sections are hollow structures formed of spin-molded plastic.

4. The system of claim 3, wherein at least one of said plastic sections comprising a spacer section, said spacer section having means for connecting to an adjacent one of said plastic sections disposed above said spacer section and means for connecting to an adjacent one of said plastic sections disposed below said spacer section.

5. The system of claim 4, wherein said spacer section is adapted to separate two of said plastic sections.

6. The system of claim 1, wherein said display surface is arranged between 45° and 65° from horizontal.

7. The system of claim 6, wherein each said means for connecting to said adjacent one of said plastic sections comprises one of vertical studs and apertures.

8. The system of claims 7, wherein said vertical studs comprise threaded, substantially cylindrical structures.

9. The system of claim 8, wherein said horizontal shelf structure of said shelf section extends horizontally beyond said walls of said shelf section.

10. The system of claim 8, wherein said horizontal structure of said shelf section comprises a substantially vertical structure at an end of said horizontal piece which extends beyond said walls of said shelf section.

11. The system of claim 1, wherein said horizontal bottom plate structure extends horizontally beyond said walls of said base section.

* * * * *